United States Patent [19]

Yoshida et al.

[11] Patent Number: 4,689,091

[45] Date of Patent: Aug. 25, 1987

[54] PROCESS FOR PRODUCING ZIRCONIUM-BASED ALLOY

[75] Inventors: Toshimi Yoshida; Hideo Maki, both of Katsuta; Hajime Umehara, Hitachi; Tetsuo Yasuda, Hitachi; Isao Masaoka, Hitachi; Iwao Takase, Tohkai; Masahisa Inagaki, Hitachi; Ryutarou Jimbow, Hitachiohta; Keiichi Kuniya, Hitachi, all of Japan

[73] Assignee: Hitachi, Ltd., Tokyo, Japan

[21] Appl. No.: 704,208

[22] Filed: Feb. 22, 1985

Related U.S. Application Data

[63] Continuation of Ser. No. 400,252, Jul. 21, 1982, abandoned.

[30] Foreign Application Priority Data

Jul. 29, 1981 [JP] Japan ..... 56-119739
Jul. 29, 1981 [JP] Japan ..... 59-119740

[51] Int. Cl.[4] ..... C21D 8/00
[52] U.S. Cl. ..... 148/11.5 F; 148/421

[58] Field of Search ..... 148/11.5 F, 133; 420/422; 376/900

[56] References Cited

U.S. PATENT DOCUMENTS 3,865,635 2/1975 Hofvenstan ..... 148/11.5 F
4,450,016 5/1984 Vesterlund ..... 148/11.5 F

*Primary Examiner*—L. DeWayne Rutledge
*Assistant Examiner*—Deborah Yee
*Attorney, Agent, or Firm*—Antonelli, Terry & Wands

[57] ABSTRACT

In a process for producing a zirconium-based alloy in which after the zirconium-based alloy is subjected to hot plastic working, it is subjected to cold plastic working and then to annealing and these steps are repeated at least twice, the present invention provides a process for producing a zirconium-based alloy characterized in that after the alloy is subjected to solid solution treatment in which it is heated to a temperature within the range including the $\alpha$ phase and the $\beta$ phase of the alloy, or within the range of the $\beta$ phase and is then quenched, cold plastic working is effected at least twice.

19 Claims, 5 Drawing Figures

PROCESS FOR PRODUCING ZIRCONIUM-BASED ALLOY

This is a continuation of application Ser. No. 400,252, filed July 21, 1982, now abandoned.

BACKGROUND OF THE INVENTION (1) Field of the Invention

This invention relates to a novel process for producing a zirconium-based alloy. In particular, the invention relates to a zirconium-based alloy having high corrosion resistance to high temperature vapors.

(2) Description of the Prior Art

Zirconium-based alloys have excellent corrosion resistance and an extremely small neutron absorbing cross-section and are therefore used for the structural members of atomic power plants such as the fuel cladding pipes, fuel channel boxes, fuel spacers, and so forth.

These structural members are always exposed to neutrons as well as the high temperature, high pressure water or vapor inside the reactor for an extended period of time, so that oxidation proceeds to such an extent that the plant operation is significantly affected. Hence, the corrosion resistance of these zirconium-based alloys must be improved. If the alloys have low corrosion resistance, the working ratio of the plants operations will drop.

At the same time, the life-time of the fuel rods has been extended (the combustibility of the rods has been increased) in recent years and severer requirements have been imposed on the corrosion resistance of fuel cladding pipes.

Typical examples of zirconium-based alloys used for the structural members of atomic power plants include "Zircaloy-2" (a zirconium alloy containing about 1.5% by weight Sn, about 0.1% Fe, 0.1% Cr and about 0.05% Ni) and "Zircaloy-4" (a zirconium alloy containing about 1.5% by weight Sn, about 0.2% Fe and about 0.1% Cr). The production processes for these Zr-based alloys are disclosed in U.S. Pat. No. 3,865,635 and U.S. patent application Ser. Nos. 632,478 (1975) and 552,794 (1975).

U.S. Pat. No. 3,865,635 discloses a process in which the alloy is heated to a temperature within the $\beta$ phase range and is then subjected to cold working and annealing before final cold working. In accordance with this process, however, after solid solution treatment is carried out in the $\beta$ phase, final cold working is effected, followed by annealing. Accordingly, the crystal grains of the resulting alloy are large, and the tensile strength as well as the toughness are low. Since the alloy after the solid solution treatment has a high hardness, the subsequent cold working step is difficult to practice and this also results in the difficulty in further reducing the crystal grain size.

U.S. patent application Ser. Nos. 632,478 (1975) and 552,794 (1975) disclose a heat-treating process in which after the starting blank is shaped into the form of the final product, it is heated to a temperature within the $\beta$ phase range or within the $(\alpha+\beta)$ phase range and then quenched. In accordance with these processes, however, deformation is likely to occur because the blank is quenched from a high temperature and hence, mold working must be carried out after the heat-treatment. However, the heating and cooling steps of a blank in the form of the final product are difficult to control and the problem of residual stress develops besides the problems of the oxidation of the surface and deformation due to thermal stress. To solve these problems, the oxide film must be removed and the deformation corrected by $\beta$-annealing.

In any of the abovementioned heat-treating processes an elongated blank must be heat-treated, and an extended period of time is necessary for the heat-treatment if a zone heat-treating process is employed in which the heating and cooling of the blank are carried out locally and continuously.

SUMMARY OF THE INVENTION (1) Object of the Invention

It is a primary object of the present invention to provide a process for producing a zirconium-based alloy which has a high strength and toughness and has excellent corrosion resistance. More specifically, the present invention is directed to provide a process for producing a zirconium-based alloy which has excellent corrosion resistance to high temperature, high pressure water.

(2) Statement of the Invention

In a process in which after a zirconium-based alloy consisting of 1 to 2 wt. % of Sn, 0.05 to 0.3 wt. % of Fe, 0.05 to 0.2 wt. % of Cr, up to 0.1 wt. % of Ni, and the balance being substantially of Zr, is subjected to hot plastic working, it is subjected to cold plastic working at a temperature lower than the recrystallization temperature of the alloy, and then to annealing, at a temperature of 400°-640° C., which is higher than the recrystallization temperature for said alloy theses steps being repeated at least twice, the process for producing a zirconium-based alloy in accordance with the present invention is characterized in that after the alloy is subjected to solid solution treatment in which the alloy is heated to a temperature within the range including the $\alpha$ phase and the $\beta$ phase of the alloy, or within the range of the $\beta$ phase and is then quenched, after the abovementioned hot plastic working, the alloy is subjected to cold plastic working at least twice.

Conventionally, solid solution treatment is carried out after the ingot of zirconium-based alloy is forged in the $\beta$ phase. This solid solution treatment induces a solid solution of the alloy elements in the matrix, but intermetallic compounds (such as $ZrCr_2$, $Zr_xFe_5Cr_2$, etc.) are separated by the subsequent forging step in the $\alpha$ phase and hot extrusion machining, and become coarser, reducing the corrosion resistance of the alloy.

In accordance with the process of the present invention, however, solid solution treatment is effected after the forgoing in the $\alpha$ phase and hot plastic working so that a solid solution of the compounds separated by the hot plastic working occur. Hence, the resulting product has a high corrosion resistance. Furthermore, since cold plastic working and annealing are effected at least twice after the solid solution treatment, the crystal grain size becomes smaller, providing a higher strength and toughness. The material after the solid solution treatment has large crystal grains and the working ratio by single cold plastic working is limited and consequently, the crystal grain size can not be sufficiently reduced. However, if cold plastic working if effected at least twice, the grain size can be made sufficiently small and the corrosion resistance and mechanical properties, especially the toughness, can be improved.

It is preferable that in the present invention, after the solid solution treatment in the $\beta$ phase range, the zirconium alloy is subjected to hot plastic working such as forging in the $\alpha$ phase and hot extrusion, is then subjected to solid solution treatment either in the $\beta$ phase range or in the $(\alpha+\beta)$ phase range, and is thereafter subjected to cold plastic working at least twice.

The combination of solid solution treatment in the $\beta$ phase range prior to hot plastic working, and solid solution treatment at a temperature within the $(\alpha+\beta)$ phase range and then quenching is also effective. Even if the crystal grains become larger after the heating within the $\beta$ phase range, the subsequent heating within the $(\alpha+\beta)$ phase range and quenching can improve the internal structure.

It is preferable that the zirconium alloy is subjected to hot plastic working without solid solution treatment and is then subjected to solid solution treatment in the $\beta$ phase prior to cold plastic working at least twice. This process can improve corrosion resistance.

It is also effective to carry out the solid solution treatment before cold plastic working in such a fashion that after the final hot working is completed, the alloy is heated to a temperature within the range of the $\beta$ phase or the range of the $(\alpha+\beta)$ phase without being cooled down to room temperature.

In a process for producing a zirconium-based alloy which includes the steps of forging an ingot of zirconium-based alloy within the $\beta$ phase range, subjecting it to solid solution treatment within the $\beta$ phase range, hot-extruding a tubular blank and subjecting the blank to cold plastic working and then to annealing and repeating these latter steps sequentially, the process in accordance with the present invention is characterized in that solid solution treatment is effected at a temperature within the $(\alpha+\beta)$ phase range or the $\beta$ phase range after the abovementioned hot extrusion step but before the first cold plastic working step.

Forging in the $\alpha$ phase is often carried out after the solid solution treatment in the $\beta$ phase range but before hot extrusion in order to adjust the dimensions. Hot extrusion and forging in the $\alpha$ phase are preferably carried out at a temperature within the range of 400° to 640° C.

Annealing after the solid solution treatment is preferably carried out at a temperature within the range of 400° to 640° C. for 2 to 4 hours in order to prevent the reduction of the corrosion resistance. Annealing after the final cold plastic working step is preferably carried out at a temperature within the range of 400° to 550° C. in order to maintain the high strength. The number of times the cold plastic working and annealing is performed is preferably three times.

If the zirconium-based alloy consists of a thin member, the solid solution treatment to be effected after hot plastic working but before cold plastic working is preferably carried out by zone heat-treatment in which the thin member is locally heated and the heated portion is continuously moved and is continuously quenched with water. If the alloy is a thick member, the entire member is simultaneously heated and then quenched immediately after hot plastic working.

The solid solution treating temperature in the $\beta$ phase range and the forging temperature are preferably between 1,000° and 1,100° C., and the period of time the solid solution treatment is maintained after hot plastic working, but before at least two cold plastic working treatments, is preferably 5 minutes or less.

The solid solution treatment at a temperature within the range including both $\alpha$ and $\beta$ phases is preferably carried out at a temperature in the range of from 860° to 930° C. and this temperature is maintained preferably for 5 minutes or less.

The hot plastic working steps including hot extrusion and forging in the $\alpha$ phase are preferably carried out at a temperature within the range of 400° to 640° C. Accordingly, if the hot plastic working steps and the annealing steps are all carried out at a temperature within the range of from 400° to 640° C., the solid solution treatment after hot working can be eliminated.

The zirconium-based alloy preferably consists of 1 to 2% by weight of Sn, 0.05 to 0.3% of Fe, 0.05 to 0.2% of Cr, up to 0.1% of Ni and the balance substantially consisting of Zr because such an alloy has excellent corrosion resistance to high temperature, high pressure water.

Figure 1:
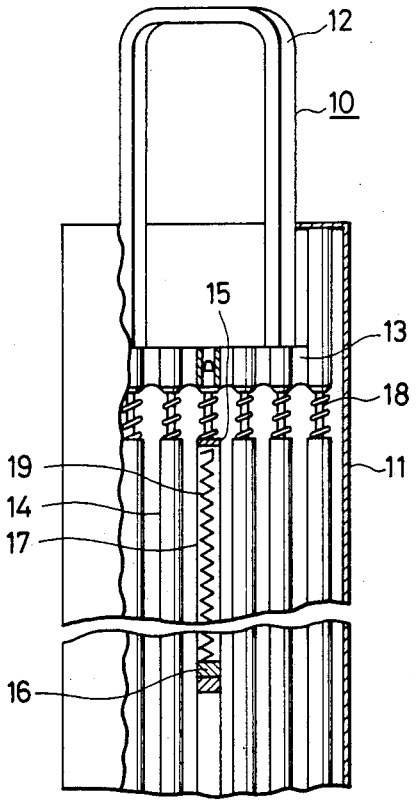
FIG. 1 is a partial sectional view of a fuel aggregate 10 consisting of fuel cladding pipes 17, a fuel aggregate channel box 11 and the like as the structural members inside an atomic power plant to which the zirconium-based alloy produced in accordance with the present invention is applied, and reference numbers represent the following members.

13: Tie plate, 14: Fuel element, 15, 16: End caps, 18: Stud, 19: Fuel support means.

Though not shown in the drawing, fuel spacers are disposed at the center of the channel box so as to support the fuel elements 14.

Figure 2:
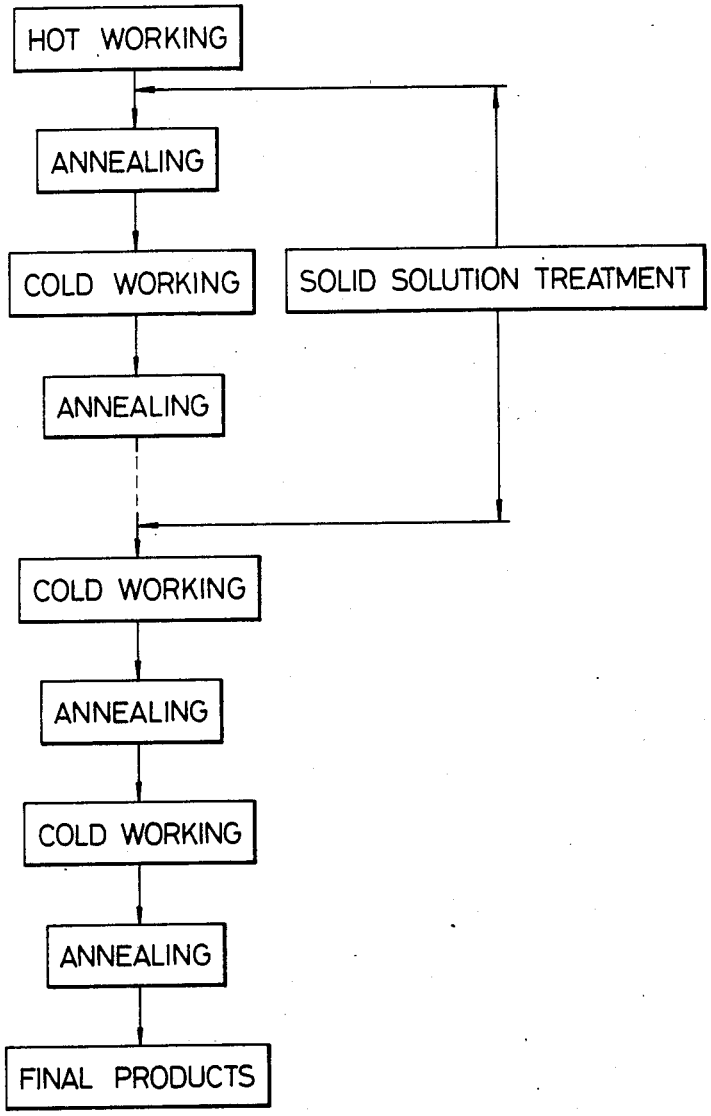
Figure 3:
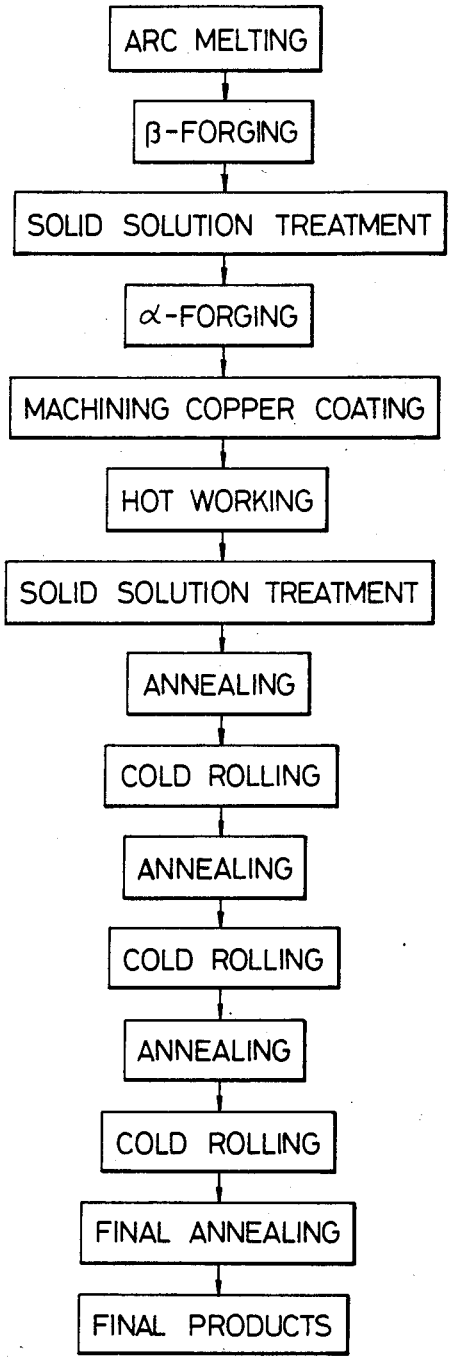

FIGS. 2 and 3 are block diagrams, each showing the production steps of the zirconium-based alloy in accordance with the present invention. In the production steps shown in FIG. 2, the steps as far as hot working are the same as those of the conventional process. As shown, solid solution treatment can be effected at any time after hot working and before performing the cold working at least twice. FIG. 3 shows the production steps of the zirconium-based alloy in accordance with one embodiment of the present invention.

Figure 4:
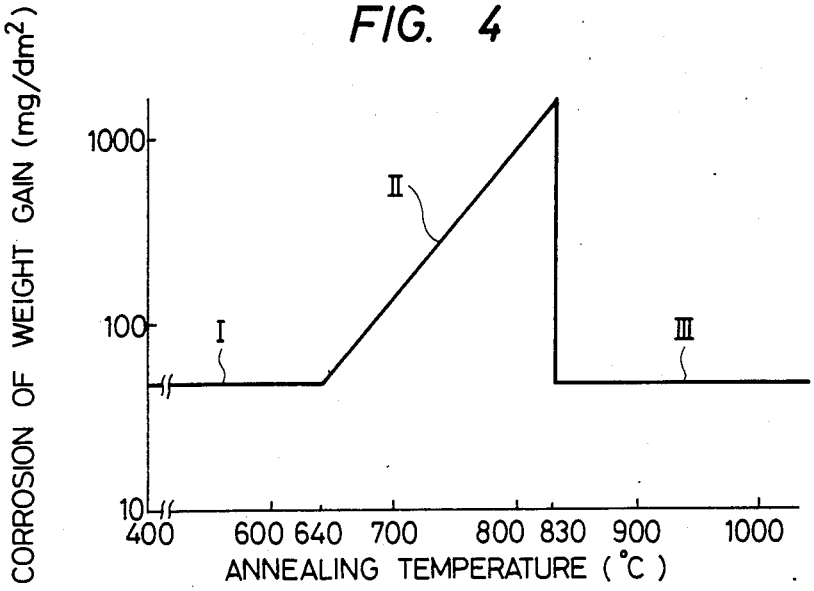
Figure 5:
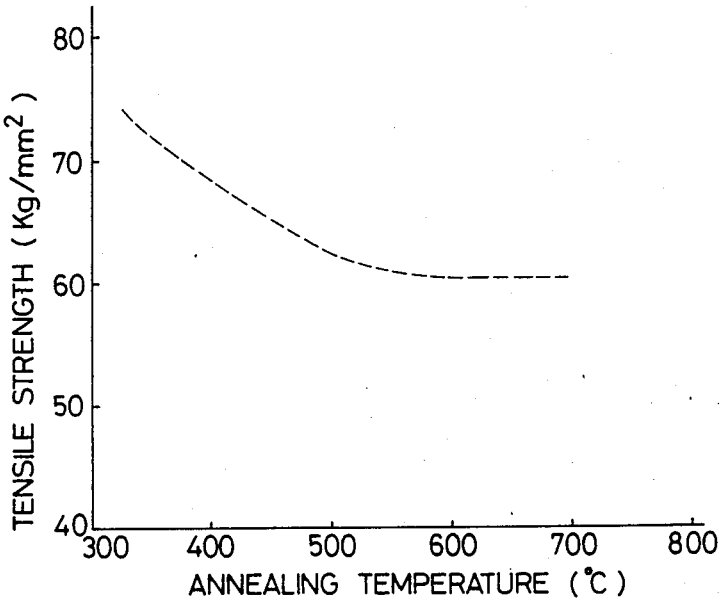

FIG. 4 is a diagram showing the relationship between the annealing temperature and the weight gain due to corrosion of the zirconium-based alloy, and FIG. 5 is a diagram showing the relationship between the annealing temperature and the tensile strength of the zirconium-based alloy.

DESCRIPTION OF THE PREFERRED EMBODIMENTS

Hereinafter, the present invention will be described in further details with reference to examples thereof that are merely illustrative but not limitative in any manner.

Example 1

The zirconium alloy used in this example consisted of 1.5% by weight Sn—0.136% Fe—0.097% Cr—0.056% Ni and the balance was Zr. This alloy was produced in accordance with the production steps shown in FIG. 3. For comparison, an alloy was produced in the same way except that instead of the annealing step prior to the final cold rolling step, solid solution treatment was effected by heating the alloy locally and continuously at 1,000° C. for 30 seconds by high-frequency heating and then quenching it with water. These production steps are representative of an example of the production of fuel cladding pipes for a boiling-water atomic power plant and will be hereinafter explained in further detail.

(1) Melting:

The sponge zirconium as raw material and the predetermined alloy elements (Sn, Fe, Cr, Ni) were blended and the mixture was compressed to form a cylindrical briquet. It was fusion-welded in an inert atmosphere and was finished into an electrode. The electrode was melted two times in a vacuum consumable electrode type arc furnace and casted into an ingot. The ingot had a diameter of 420 mm and a length of 1,550 mm.

(2) $\beta$-Forging:

The ingot was pre-heated to the $\beta$ phase range temperature (about 1,000° C.) and was forged at that temperature into a bloom.

(3) Solid Solution Treatment:

After $\beta$-forging, the bloom was subjected to solid solution treatment by heating it to a temperature in the $\beta$ phase range (1,000° C. or above, kept for several hours) and then quenching it (in water). This treatment homogenizes the distribution of the alloy elements that had existed unevenly and improves the metallic structure.

(4) $\alpha$-Forging:

After the surface oxide film formed by the solid solution treatment was removed, the bloom was forged within the $\alpha$ phase temperature range, i.e., around 700° C., to adjust the dimensions.

(5) Machining and Copper Coating:

After $\alpha$-forging, the bloom was machined and bored to form a hollow billet, to which copper plating was applied by electroplating or chemical plating in order to prevent oxidation and gas absorption, and to improve its lubricating properties during hot extrusion.

(6) Hot Working (Hot Extrusion):

The copper coated billet was extruded by a press through a die at a temperature of around 700° C. within the $\alpha$ phase range to form an extruded blank pipe having an outer diameter of 63 mm, an inner diameter of 42 mm and a length of 2,790 mm.

(7) Solid Solution Treatment:

After hot working, the blank pipe was held at 1,000° C. for 5 minutes in inert gas and was then quenched with water from that temperature.

(8) Annealing:

The pipe was heated to a temperature of around 650° C. in a high vacuum of $10^{-4}$ to $10^{-5}$ Torr in order to remove the strains resulting from the working. The pipe was held for 3 hours at this temperature.

(9) Cold Rolling:

The outer diameter of the pipe was reduced by rolling at room temperature to reduce the thickness of the pipe. Cold rolling was repeated three times alternating with annealing until the predetermined dimensions were attained. The outer diameter and inner diameter of the pipe became 44 mm and 29 mm in the first pass, 25.5 mm and 18.5 mm in the second pass and 12.5 mm and 10.8 mm in the third pass, respectively.

(10) Final Annealing: p Annealing was carried out at around 580° C. in a vacuum as high as $10^{-4}$ to $10^{-5}$ Torr in order to realize recyrstallization. This temperature was maintained for three hours.

As can be understood, the pipe was as short as about 3 m after hot working, and about 29 m after the first cold rolling but became considerably longer after the subsequent cold rolling. If the solid solution treatment is carried out by using zone heat treatment, an extremely long period of time will be needed.

Using the zircaloy pipes produced by the two methods above, a corrosion test and a 288° C. tensile test were carried out. The corrosion test was carried out by holding each testpiece in a high temperature, high pressure vapor of 500° C. and 105 kg/cm$^2$ for 20 hours and after the test was completed, both testpieces were compared by observing their appearance.

The pipe produced in accordance with the process of the present invention exhibited noticeably less white color resulting from nodular corrosion and showed excellent corrosion resistance and mechanical properties, i.e., a tensile strength of 28.5 kg/mm$^2$ and a tensile elongation of 31%. Furthermore, the pipe of the alloy of the present invention had a crystal grain size of at least ASTM number 11 and fine crystal grains.

The comparison pipe was inferior to the pipe using the alloy of the present invention in both corrosion resistance and mechanical properties. The difference was believed to arise from the fact that the size of the crystal grains in the comparison pipe was greater than that of the present pipe.

The term "nodular corrosion" used herein means the occurrence of white spots as the oxidation reaction proceeds locally and abnormally during the process of oxidation of the zirconium-based alloy. Though the black oxide film has protective properties, the white oxide does not have protective properties but has only a low corrosion resistance.

In comparison with the comparison process, the process of the present invention makes rolling easier because annealing is carried out after the solid solution treatment. Furthermore, since the cold rolling and annealing are each carried out three times after the solid solution treatment, the direction of the resulting hydrides can be aligned with the circumference of the pipe so that the resistance to stress corrosion cracking can be greatly improved.

Example 2

In this example, the testpiece was produced in the same way as in Example 1 except that the solid solution treatment after $\beta$-forging but before $\alpha$-forging in FIG. 3 was omitted. The resulting testpiece was subjected to tensile and corrosion tests in the same way as in Example 1.

The corrosion state and tensile properties of the testpiece were substantially the same as those in Example 1 and the testpiece was found to have excellent corrosion resistance, strength and tensile characteristics. The crystal grain size was substantially the same as that of Example 1 and the other properties were also substantially the same as those of Example 1.

Example 3

The zirconium-based alloy used in this example consisted of 1.5% by weight Sn, 0.2% Fe, 0.1% Cr and the balance of Zr. The alloy was subjected to arc melting, $\beta$-forging, $\alpha$-forging and hot working in the same way as in Example 1, followed by the heat-treatment and the corrosion test using high temperature, high pressure vapor to be described below.

The heat-treatment was carried out by vacuum-sealing a testpiece in a silica glass tube. After vacuum-sealed, the testpiece was held at a $\beta$-phase range temperature for about 5 minutes and was then dipped into water for quenching at a rate of at least 200° C./second. After quenching, the testpiece was annealed at various temperatures for 2 hours. After annealing, the testpiece was dipped into water for quenching in order to avoid changes of corrosion resistance due to the separation and growth of intermetallic compounds that would occur if a slow cooling were used. The testpiece was then subjected to a corrosion test using high temperature vapor.

FIG. 4 shows the relationship between the weight gain due to corrosion and the annealing temperature after the testpiece was held in a high temperature, high pressure vapor of 500° C. and 105 kg/cm$^2$ for 60 hours. The annealing temperature can be classified into the following three ranges according to the corrosion weight gain tendencies.

Temperature Range I: up to 640° C.

No degradation of corrosion resistance can be observed even if annealing is effected. This temperature is preferably up to 620° C. and most preferably, up to 600° C.

Temperature Range II: from 640° C. to 830° C.

The weight gain due to corrosion increases with the rise in annealing temperature (decreasing corrosion resistance). In this temperature range, diffusion of the alloy elements becomes possible. It is therefore believed that separation of the intermetallic compounds is promoted by the diffusion and corrosion resistance is reduced.

Temperature Range III: 830° C. or above

Corrosion resistance increases irrespective of the annealing temperature. In this temperature range the transformation from the $\alpha$ phase to the $\beta$ phase starts occurring. The $\alpha$ phase changes to the $\beta$ phase partially within the range of 830° to 960° C. and completely at temperatures above 960° C. As the socalled solid solution treatment is effected by quenching after annealing, corrosion resistance is improved. In the ordinary working processes, however, the cooling after annealing or hot rolling is a slow cooling so that improvements in corrosion resistance within this temperature range cannot be expected.

On the other hand, there is a close interrelation between the separation conditions of intermetallic compounds [e.g. $Zr(Cr_2Fe)_2$], especially the grain size of the separated compounds, and corrosion resistance. In a zirconium-based alloy having a high corrosion resistance which is annealed at below 640° C., the average grain diameter of the separated compounds is up to 0.2 μm, but in those zirconium-based alloys having reducing corrosion resistance which are annealed at a higher temperature, the average grain size of the separated compounds exceeds 0.2 μm and can become considerably greater.

FIG. 5 is a diagram showing the relationship between the annealing temperature and the tensile strength at room temperature. It can be seen from the diagram that the alloy shows high strength at annealing temperatures of up to 550° C.

As described above, high corrosion resistance can be maintained by subjecting the alloy to a solid solution treatment, after the final hot plastic working, in which the alloy is heated to a temperature within the $\beta$ phase range and is then quenched and then is held at a subsequent annealing temperature of up to 640° C., even if the working before the solid solution treatment is effected at such a temperature which reduces the corrosion resistance.

On the basis of the abovementioned concept, a fuel cladding pipe for a boiling-water reactor, consisting of the alloy of Example 1, was manufactured in accordance with the production steps shown in Table 2 and was then subjected to corrosion and tensile tests in the same way as described previously.

TABLE 2

| Step No. | Step | Temperature condition (Method I) | Temperature condition (Method II) |
|---|---|---|---|
| (1) | Melting | Arc melting | Arc melting |
| (2) | $\beta$-forging | Approx. 1,000° C. | Approx. 1,000° C. |
| (3) | Solid solution treatment | 1,020–1,050 | 1,020–1,050 |
| (4) | $\alpha$-forging | Approx. 700° C. | Approx. 700° C. |
| (5) | Machining | Room temperature | Room temperature |
| (6) | Hot extrusion | Approx. 700° C. | Approx. 700° C. |
| (7) | Annealing | Solid solution treatment in ($\alpha + \beta$) phase | Annealing at 650° C. |
| (8) | Cold rolling (1st) | Room temperature | Room temperature |
| (9) | Annealing | 600° C. | Solid solution treatment in ($\alpha + \beta$) phase |
| (10) | Cold rolling (2nd) | Room temperature | Room temperature |
| (11) | Annealing | 600° C. | 600° C. |
| (12) | Cold rolling (3rd) | Room temperature | Room temperature |
| (13) | Final annealing | 580° C. | 580° C. |

The production steps as far as the hot extrusion were the same as those of the conventional process. In Method I, solid solution treatment within the ($\alpha+\beta$) phase was effected instead of annealing after hot extrusion. Heating was effected by a high-frequency heating method by hot-extruding the blank and then passing it through a high-frequency induction coil while keeping it continuously at 900° C. for 30 seconds. Cooling was effected by spraying hot or cold water onto the inner and outer surfaces of the blank immediately after it had passed through the high-frequency induction coil. Thereafter, rolling at room temperature and annealing at 600° C. were repeated, and final annealing was effected at 580° C. This method reduced the number of heat-treatment steps.

In method II, solid solution treatment in the ($\alpha+\beta$) phase was effected in the same way as in Method I after the first cold rolling instead of annealing, and the subsequent steps were the same as those of Method I. This method reduces the number of production steps in comparison with the conventional process.

The mechanical properties of the pipes manufactured after final annealing were substantially the same as those of the pipe in the aforementioned Example 1, and the corrosion resistance was also excellent as shown by the corrosion weight gain in the area I in FIG. 4. The other properties were also substantially comparable to those of the pipe of the present invention illustrated in Example 1. The annealing temperature after the solid solution treatment in the ($\alpha+\beta$) phase is preferably between 550° and 640° C.

EXAMPLE 4

The process of the present invention was applied to the production of a fuel cladding pipe for a pressurized water reactor, the cladding pipe being made of the zirconium-based alloy of Example 3.

This process was the same as those of Methods I and II in Table 2 except that final annealing was effected at a temperature within the range of 400° to 500° C. in order to improve the mechanical strength. According to this process, the resulting pipe had a higher strength than the pipe of Example 3 as shown in FIG. 5, and the corrosion resistance was substantially the same as that of the pipe of Example 3.

EXAMPLE 5

In this example, annealing at a temperature within the range of 550° to 620° C. was effected after the solid solution treatment in the $(\alpha+\beta)$ phase range in the production steps of Methods I and II of Table 2 of Example 3.

This made it possible to mitigate the hardening arising from the solid solution treatment in the $(\alpha+\beta)$ phase considerably, and to carry out rolling more easily. The resulting pipe had excellent corrosion resistance, substantially comparable to that of the pipe of Example 4.

EXAMPLE 6

The zirconium-based alloy of Example 1 was used for a fuel cladding pipe for a boiling-water reactor in accordance with the production steps illustrated in Table 3.

TABLE 3

| Step No. | Step | Temperature conditions |
|---|---|---|
| (1) | Melting | (Arc melting) |
| (2) | $\beta$-forging | 1,000° C. |
| (3) | Solid solution treatment | 1,020–1,050° C. |
| (4) | $\alpha$-forging | 600° C. |
| (5) | Machining | Room temperature |
| (6) | Hot extrusion | 600° C. |
| (7) | Annealing | 600° C. |
| (8) | Rolling (1st) | Room temperature |
| (9) | Annealing | 600° C. |
| (10) | Rolling (2nd) | Room temperature |
| (11) | Annealing | 600° C. |
| (12) | Rolling (3rd) | Room temperature |
| (13) | Final annealing | 580° C. |

The production steps as far as the solid solution treatment were the same as those of the conventional process. After the solid solution treatment, the pipe was heated to 600° C. and was then subjected to $\alpha$-forging. After heated to 600° C., the pipe was hot-extruded and thereafter the vacuum annealing at 600° C. and the rolling at room temperature were repeated three times. Recrystallization annealing (at about 580° C.) was carried out as the final annealing. Generally, the metal temperature rises during forging and extrusion, but the abovementioned $\alpha$-forging and hot extrusion temperatures of 600° C. were controlled so that the temperature did not exceed 640° C. even if the temperature did rise due to the forging and extrusion.

As a result of a corrosion test performed in the same way as in the aforementioned examples, the pipe was found to have an excellent corrosion resistance substantially comparable to the corrosion resistance in the area I in FIG. 4. The other properties were also substantially the same as those of the pipe of the alloy of the present invention of Example 1.

EXAMPLE 7

In this example, the $\alpha$-forging of Example 6 was omitted but annealing and machining at between 550° and 640° C. were added. The resulting pipe had corrosion resistance comparable to that of the pipe of Example 5. This annealing made it possible to mitigate the hardening arising from the solid solution treatment, and to carry out the working more easily.

EXAMPLE 8

The zirconium-based alloy of Example 3 was used for a fuel cladding pipe for a pressurized water reactor in accordance with the production steps illustrated in Table 3. The process was the same as that of Example 6 except that final annealing in Table 3 was effected at a temperature in the range of 400° to 500° C. in order to improve the mechanical strength. In accordance with this process, the strength as well as the corrosion resistance could be improved.

Although the fuel channel boxes and fuel spacers that are made of zirconium-based alloy have different shapes from that of the fuel cladding pipes, boxes and spacers having excellent corrosion resistance can be produced in essentially the same way as the process of the fuel cladding pipe by following the productions steps including arc melting, $\beta$-forging, solid solution treatment, hot plastic machining, repeated plastic working at room temperature interspaced with annealing, final plastic working and final annealing.

As described in the foregoing, the present invention makes it possible to reduce the heat-treatment time and to improve the strength and corrosion resistance of the zirconium-based alloys, especially those of zircaloys. Hence, the present invention can improve the service life of reactor instruments and appliances remarkably, especially the fuel rod cladding pipes, channel boxes and fuel spacers.

What is claimed is:

1. The process for producing a zirconium-based alloy comprising the steps of:

heating a zirconium-based alloy at a temperature allowing the $\alpha$ and $\beta$ phases thereof to coexist or the $\beta$ phase thereof alone to exist as a single phase and quenching the heated alloy to effect a solid solution treatment;

heating the treated alloy to a high temperature of 400°–640° C., and hot plastic working the heated alloy; and subjecting the resulting alloy to a combination of cold plastic working, and annealing at a high temperature of 400°–640° C., at least once, wherein the alloy is not subjected to a solid-solution treatment after the hot plastic working performed on the treated alloy heated to 400°–640° C., whereby, since said hot plastic working and said annealing are performed after the solid solution treatment, reduction of corrosion resistance due to the high temperature processing of the alloy can be prevented without any solid solution treatment after the hot plastic working.

2. The process for producing a zirconium-based alloy as defined in claim 1, wherein the cold plastic working includes a final cold plastic working, and the annealing following the final cold plastic working is effected at about 580° C.

3. The process for producing a zirconium-based alloy as defined in claim 1, wherein the cold plastic working includes a final cold plastic working, and the annealing following the final cold plastic working is effected at 400° to 550° C.

4. The process for producing a zirconium-based alloy as defined in claim 1, wherein the hot plastic working includes a final hot plastic working, which process further comprises the step of annealing the alloy at 400°–640° C. after the final hot plastic working and before the cold plastic working.

5. The process for producing a zirconium-based alloy as defined in claim 1, wherein the solid solution treatment includes a final solid solution treatment, which process futher comprises the step of annealing the alloy at 400°-640° C. after the final solid solution treatment.

6. The process for producing a zirconium-based alloy as defined in claim 1, including the further step of forming said alloy into at least one member of the group consisting of a nuclear fuel cladding, a fuel rod spacer, a fuel channel box and a fuel bundle.

7. The process for producing a zirconium-based alloy as defined in claim 1, including the further step of forming said alloy into a nuclear reactor structural member.

8. Product formed by the process of claim 1.

9. The process for producing a zirconium-based alloy comprising the steps of:

heating a zirconium-based alloy at a temperature allowing the $\beta$ phase thereof to exist as a single phase and quenching the heated alloy to effect a solid solution treatment;

subjecting the treated alloy to hot plastic working at a temperature within a temperature range of the single $\alpha$ phase;

heating the resulting alloy at a temperature allowing the $\alpha$ and $\beta$ phases thereof to coexist and quenching the heated alloy to effect another solid solution treatment;

heating said another solid solution treated alloy to a high temperature of 400°-640° C., and hot plastic working the heated alloy; and subjecting the resulting alloy to a combination of cold plastic working, and annealing at a high temperature of 400°-640° C., at least once, whereby, since the alloy is heated for hot plastic working, and annealing is performed, at a temperature in the range of 400°-640° C. after said another solid solution treatment, reduction of corrosion resistance due to high temperature processing of the alloy can be prevented without any solid solution treatment after the hot plastic working.

10. The process for producing a zirconium-based alloy as defined in claim 9, wherein the cold plastic working includes a final cold plastic working, and the annealing following the final cold plastic working is effected at about 580° C.

11. The process for producing a zirconium-based alloy as defined in claim 9, wherein the cold plastic working includes a final cold plastic working, and the annealing following the final cold plastic working is effected at 400° to 550° C.

12. The process for producing a zirconium-based alloy as defined in claim 9, wherein said hot plastic working includes a final hot plastic working, which process further comprises the step of annealing the alloy at 400°-640° C. after the final hot plastic working and before the cold plastic working.

13. The process for producing a zirconium-based alloy as defined in claim 9, wherein said solid solution treatment includes a final solid solution treatment, which process further comprises the step of annealing the alloy at 400°-640° C. after the final solid solution treatment.

14. The process for producing a zirconium-based alloy as defined in claim 9, including the further step of forming said alloy into at least one member of the group consisting of a nuclear fuel cladding, a fuel rod spacer, a fuel channel box and a fuel bundle.

15. The process for producing a zirconium-based alloy as defined in claim 9, including the further step of forming said alloy into a nuclear reactor structural member.

16. Product formed by the process of claim 9.

17. The process for producing a zirconium-based alloy as defined in claim 9, wherein the alloy is not subjected to a solid solution treatment after the hot plastic working at a high temperature of 400°-640° C.

18. The process for producing a zirconium-based alloy as defined in claim 1, said process consisting essentially of said heating and quenching, said subjecting the treated alloy to said hot plastic working, and said subjecting the resulting alloy to a combination of cold plastic working and said annealing at least once.

19. The process for producing a zirconium-based alloy as defined in claim 9, said process consisting essentially of said heating and quenching to effect a solid solution treatment, said subjecting the treated alloy to said hot plastic working, said heating the resulting alloy and quenching to effect another solid solution treatment, said subjecting the treated alloy to said hot plastic working, and said subjecting the resulting alloy to a combination of cold plastic working and said annealing at least once.

* * * * *